United States Patent [19]

Mercer

[11] 4,277,012

[45] Jul. 7, 1981

[54] APPARATUS FOR INSTALLING A FERRULE

[75] Inventor: Robert R. Mercer, Ortonville, Mich.

[73] Assignee: General Motors Corporation, Detroit, Mich.

[21] Appl. No.: 119,647

[22] Filed: Feb. 8, 1980

Related U.S. Application Data

[62] Division of Ser. No. 954,751, Oct. 26, 1978, Pat. No. 4,227,294.

[51] Int. Cl.[3] ..... A43D 69/00

[52] U.S. Cl. ..... 227/68; 29/243.52

[58] Field of Search ..... 29/509, 512, 243.52, 29/283.5; 227/68, 71

[56] References Cited

U.S. PATENT DOCUMENTS

| | | | |
|---|---|---|---|
| 1,302,942 | 5/1919 | McMurray | 29/512 |
| 1,437,245 | 11/1922 | Hinchcliff | 227/68 X |
| 1,838,973 | 12/1931 | Wilder | 227/68 X |
| 2,325,929 | 8/1943 | Amesbury et al. | 29/509 |
| 3,456,483 | 7/1969 | Crothers et al. | 29/509 UX |

*Primary Examiner*—Charlie T. Moon

*Attorney, Agent, or Firm*—Charles R. Engle

[57] ABSTRACT

A two part die set and method including an upper die half supporting a male die and a lower die half containing a spring biased female die receiving the male die and cutting out an area of a panel placed therebetween. The die set is actuated by a conventional machine press of the type having a ram movable toward a fixed bed. The male punch includes a shank and an annular groove forming an area of reduced diameter supporting a ferrule with integral fastening tines. Extended movement of the punch into engagement with the panel cuts out an area of said panel and further extended movement moves the tines through the panel. Continued extended movement of the male die moves the ferrule downwardly and engages angular portions of the tines with the peripheral edge of the cut out in the panel deflecting the tines outwardly on the underneath side of the panel. Further downward movement of the male die engages its shank with the tines and forces them into frictional engagement with the peripheral edge of the panel cut out deforming a portion of the panel downwardly permanently forming a countersink in the panel around the cut out. The ferrule includes a flange in contact with the upper surface of the panel. The upper die half also has a downwardly extending abutment that engages a spring biased carriage assembly and the female die. The carriage assembly and female die are moved downwardly against the force of their biasing springs until a latching detent is cammed away from a latching surface on the female die. The female die is released permitting its biasing spring to rapidly move it upwardly clenching the ferrule tines against the underneath side of the panel securing the ferrule in placed.

3 Claims, 6 Drawing Figures

APPARATUS FOR INSTALLING A FERRULE

This is a division of application Ser. No. 954,751, filed Oct. 26, 1978, now U.S. Pat. No. 4,227,294, issued Oct. 14, 1980.

TECHNICAL FIELD

This invention relates to a method and apparatus for sequentially cutting an area of a panel and fastening a ferrule within the cut out area. More specifically, this invention relates to a method and apparatus for sequentially cutting an area out of the panel and fastening the ferrule within the cut out area in a single operation.

THE INVENTION

The apparatus of this invention preferably includes a two part die set wherein an upper die half supporting a male punch member engages a spring biased female die member secured in a lower die half permitting the panel to be cut out as the male punch engages the female die in its initial downward movement. The male punch member has an area of reduced diameter supporting a ferrule having integral downwardly extending tines. Further movement of the male punch member downwardly after cutting the area out of the panel member, causes the ferrule and its fastening tines to be inserted within the cut out portion. Continued movement of the male punch member into the female die causes the tines to be cammed outwardly away from the punch member underneath the panel member and at a predetermined point in time during further downward movement, the spring biased female die is released permitting it to move rapidly upwardly clenching the tines against the underneath side of the panel firmly securing the ferrule in place.

THE DRAWINGS

BEST MODE FOR CARRYING OUT THE INVENTION

Figure 1:
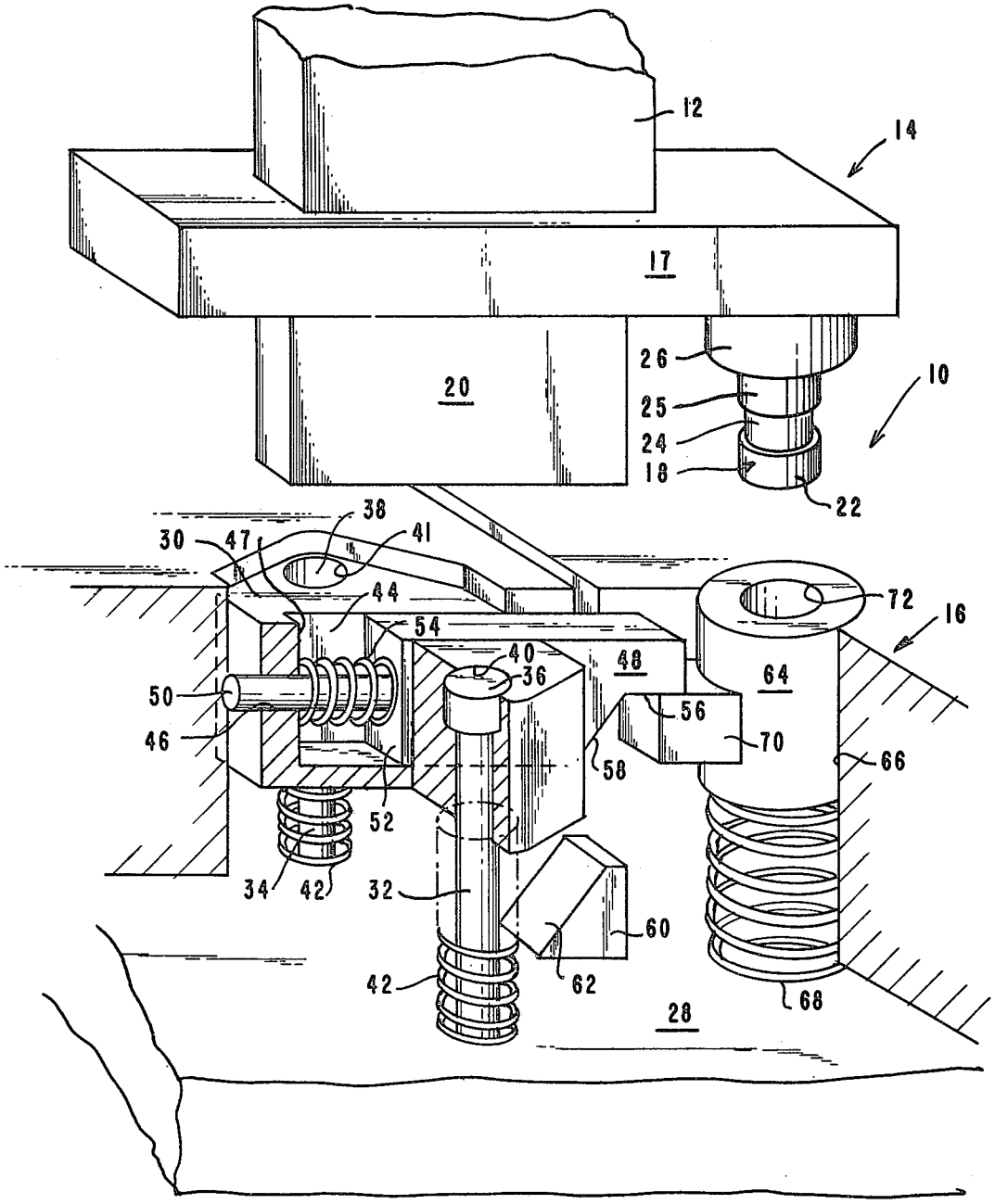
FIG. 1 is a perspective view, partly in section, illustrating the specific elements of the die set position on a machine tool for actuation thereby.

With reference now to FIG. 1, the subject invention comprises a die set 10 of the type adaptable to be actuated by a conventional press assembly including a ram member 12 when the die set 10 is placed upon a bed of the press assembly not shown. The die set 10 includes an upper die half 14 and a lower die half 16. The upper die half 14 includes an anvil member 17 fixedly supporting a male punch die 18 and an abutment 20. The male die 18 includes a cutting end 22 and an area of reduced diameter defining an annular groove 24 for a purpose to be later described. The male die 18 also includes a shank 25 of a diameter equal to that of the punch cutting end, also for a purpose to be later described.

The lower die half 16 includes a housing assembly 28 containing a spring biased carriage 30 including supporting pins 32 and 34 which are secured to the housing assembly 28 and terminate in enlarged head portions 36 and 38 received respectively in counterbores 40 and 41 in the carriage 30. Like springs 42 are each concentrically positioned upon the pins 32 and 34 and engage the underneath side of carriage 30 biasing it upwardly against head portions 36 and 38 of the pins in counterbores 40 and 41.

The carriage 30 contains a laterally extending slot 44 and a lateral axially aligned drilled hole 46 at a closed end 47 of the slot. A detent member 48 is slidably mounted in the slot 44 and has a guide pin 50 fixedly attached to end 52 receiving a coil spring 54 concentrically positioned upon the guide pin 50. Spring 54 engages the slot closed end 47 and end 52 of the detent 48 continuously urging the detent toward an extended position outwardly of the carriage 30. The detent is formed to include a locking surface 56 and a first cam surface 58. An abutment 60 is affixed to the housing assembly 28 and includes a second cam surface 62 complimentary to surface 58 of detent 48.

A female die 64 is slidably positioned in an annular groove 66 formed in housing 28 and is biased upwardly by a spring 68. The die 64 includes a latching lug 70 which normally engages locking surface 56 of the detent 48 by virtue of the biasing force of spring 68. The female die 64 contains a cutting recess 72 which is formed to mate with cutting end 22 of the male die 18 and perform the cutting of a panel member positioned therebetween.

Figure 2:
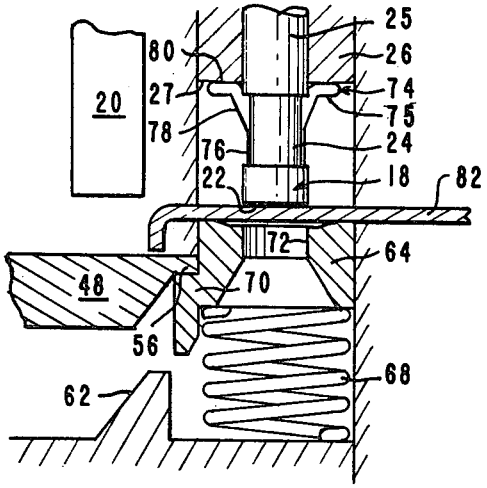
FIG. 2 is a fragmentary side elevational view taken in section illustrating the association of the male and female dies relative to a panel placed on the female die.

Referring now to FIG. 2, a ferrule or reinforcing member 74, having a retaining flange 75 and including fastening tines 76 being connected to the ferrule 74 by angular portions 78, is placed upon the male cutting die 18 with the tines 76 positioned in annular groove 24 above cutting end 22. An upper surface 80 of the ferrule flange 75 engages the underneath side 27 of bushing 26 for a purpose to be later described. A panel member 82 to be cut is placed between the male die 18 and the female die 64.

Figure 3:
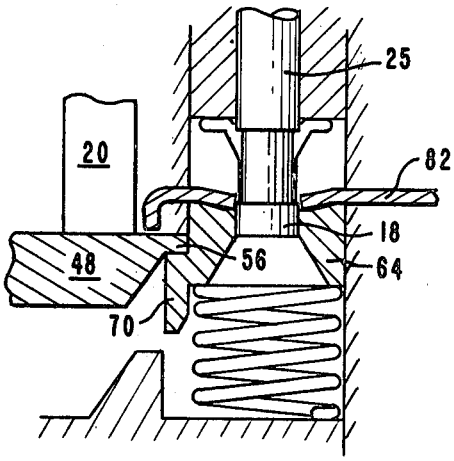
FIG. 3 is a fragmentary side elevational view in section illustrating initial movement of the male die member through the panel and into the female die.

Referring to FIG. 3, it can be seen that to perform a cutting operation the male die 18 moves downwardly through the panel member 82 into female die member 64 while simultaneously the abutment 20 engages detent 48. At this time the detent 48 is in position with locking surface 56 engaging latching lug 70 of the female die 64 so that die 64 moves downwardly with the abutment 20.

Figure 4:
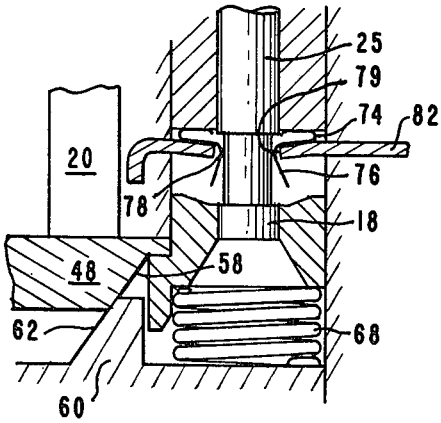
FIG. 4 is a fragmentary side elevational view in section illustrating the male die at a further extended position moving a ferrule placed upon the male die member into the cut out area of the panel.

In FIG. 4, the male cutting die 18 has progressed further downwardly engaging annular portions 78 with a circumferential edge 79 of the cut out area causing the tines 76 to flare outwardly away from the cutting die 18 in annular groove 24 as ferrule member 74 is moved through the cut out area in panel 82. The abutment 20 remains in engagement with detent 48 while cam surface 58 is initially brought into contact with mating cam surface 62 on fixed abutment 60. The female die biasing spring 68 is substantially compressed at this time.

Figure 5:
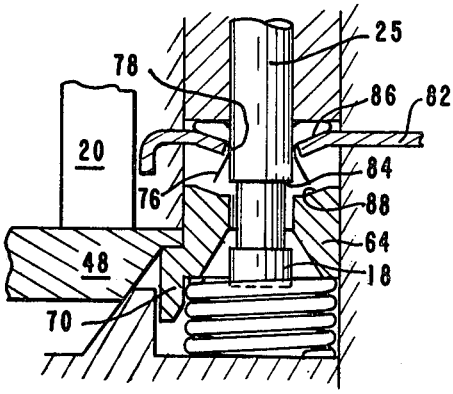
FIG. 5 is a fragmentary side elevational view illustrating movement of the male die to a further extended position wherein portions of the ferrule and the male die have engaged the edges of the cut out portion deforming the panel forming a countersink therein.
Figure 6:
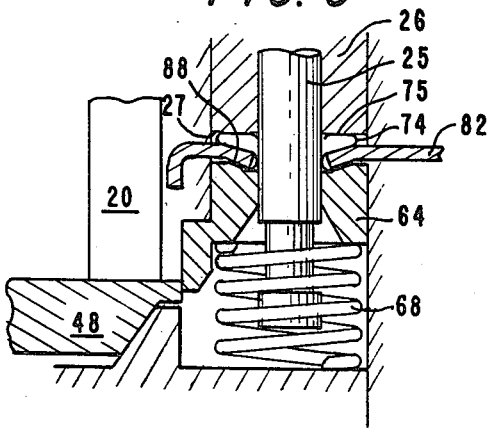
FIG. 6 is a fragmentary side elevational view taken in section illustrating the female die being released from a detent whereby it is spring biased upwardly against the underneath side of the panel countersink clenching tines of the ferrule against the underneath side of the panel securing the ferrule in place.

With reference to FIG. 5, the male die member 18 has progressed yet further downwardly and has moved shank 25 of the male die into engagement with tines 76 which in turn are in engagement with the circumferential edge 79 of the cut out area resulting in a frictional interfering engagement with the panel 82. The shank 25 is slightly tapered adjacent groove 24 providing an annular countersink camming surface 84. This interfering contact forces an area around the cut out downwardly to permanently deform the panel providing a countersink 86 around the cut out area. To accomplish this result the shank 25 is of a predetermined diameter which can be substantially equal to that of the cutting end 22. The female die 64 contains a countersink recess 88 in its upper surface which substantially conforms to the countersink 86 as shown in FIG. 6. Second cam surface 62 eventually moves detent 48 out of engagement with abutment 60 releasing the female die 64. The tines 76 are bent back against the underneath side of the panel 82 when the female die 64 moves rapidly upwardly to the position shown in FIG. 6. Since the countersink recess 88 in female die 64 substantially conforms to the countersink 86 in panel 82 the tines 76 are bent back against the underneath side of the panel 82 in substantial conformance with the countersink 86.

In operation, a ferrule 74 is placed in groove 24 of male die 18 and a panel member 82 is positioned upon female die 64. The ram 12 supporting die 18 is actuated to rapidly move the die downwardly. Cutting end 22 engages and cuts the panel 82 and abutment 20 begins to move female die 64 downwardly against the force of spring 68. Of course, the male die 18 and female die 64 can be of any form to provide a panel cut out area of a predetermined desired configuration, the disclosed circular configuration being a preferred form for purposes of illustration only. The ferrule 74 is eventually moved into the cut out and angular tine portions 78 engage edge 79 of the panel cut out area causing the tines to be deflected outwardly away from groove 24 in male die 18. At about this time as the downward movement continues, detent cam surface 58 engages mating surface 62 of the cam abutment 60. This begins initial compression of detent biasing spring 54 best illustrated in FIG. 1. As shown in FIG. 4, the female die biasing spring 68 is substantially compressed.

Further downward movement places punch shank 25 into the panel cut out area in contact with tine angular portions 78 moving them into a frictional interference engagement with edge 79 of the panel 82. Continued downward movement of the punch shank in this interference engagement permanently deforms the panel 82 to contain the countersink 86 around the cut out area. Detent 48 is also moved laterally away from the female die 64 against spring 54 removing locking surface 56 from engagement with stop member 70 thereby unlatching the female die 64. Spring 68 rapidly moves female die 64 upwardly engaging the die countersink recess 88 with tines 76 reverse bending them against the underneath side of the countersink 86 in panel 82. This reverse bending of the tines 76 is facilitated by the downward movement of bushing 26 with its end surface 27 in contact with the upper surface of ferrule flange 75 holding the ferrule 74 in place while the tines are engaged by die surface 88. The reverse bending of the tines 76 fixedly secures the ferrule in the panel cut out.

While I have shown and described a specific embodiment of the present invention it will, of course, be understood that various modifications and alternative constructions may be made without departing from its true spirit and scope. In particular, it is possible to vary the specific configuration of the cut out in the panel 82 by so designing the male die 18 and the female die 64 to any desired form. With these possibilities in mind, therefore, I intend by the appended claims to cover all modifications of the subject invention which fall within their true spirit and scope.

I claim:

1. A die set for sequentially cutting out an area of a panel and securing a reinforcing member having a plurality of fastening portions in the cut out comprising: a male die; an abutment; an anvil member capable of being actuated by a ram of a conventional press machine; both said male die and said abutment being secured to said anvil for movement therewith; a female die housing; a female die; a spring continually biasing said female die upwardly in said housing; a latching lug on said female die; a detent carriage assembly in said housing; spring means biasing said detent carriage assembly to a normal upward position; a detent mounted for lateral extended and retracted movement in said carriage assembly; spring means normally biasing said detent to an extended position into engagement with said latching lug; first cam means on said detent; second cam means on said housing; and means on said male die receiving and supporting the reinforcing member to be installed in said panel; movement of one of said dies relative to the other engaging said male die with said female die cutting out an area of a panel placed on said female die and moving the reinforcing member into the cut out; further movement of the male die into the female die expanding the fastening portions on the underneath side of the panel and engagement of said abutment compressing said female die biasing spring; extreme movement of said male die within said female die engaging said first and second cam means retracting said detent out of engagement with said latching lug permitting said female die biasing spring to rapidly move said female die upwardly clenching said fastening portions against the underneath side of said panel securing said reinforcing member in said panel cut out.

2. A die set for sequentially cutting out an area of a panel and fastening a reinforcing member having a plurality of fastening portions in the cut out comprising: a male die; a female die; a female die housing; a spring continually biasing said female die upwardly in said housing; a latching lug on said female die; detent means in said female die housing releasably actuated to latch and unlatch said female die in relation to the force of its biasing spring; means movable with said male die engaging said female die and moving it against its biasing spring compressing the spring as said male die is moved into said female die; means on said female die engaging said means movable with said male die unlatching said detent from said female die permitting its biasing spring to rapidly move said female die upwardly when said male die has moved into said female die a predetermined distance; and means on said male die receiving and supporting a reinforcing member to be installed in said panel; movement of one of said dies towards the other engaging said male die with said female die cutting out an area of a panel placed on said female die and moving the fastening portions of said reinforcing member into the cut out; further movement of the die into the female die expanding the fastening means on the underneath side of the panel while said means movable with said male die compresses said female die biasing spring; the extreme movement of said male die within said female die engaging said unlatching means releasing said detent from said female die permitting its biasing spring to rapidly move said female die upwardly clenching said fastening portions against the underneath side of said panel securing said reinforcing member in said panel cut out.

3. A die set for sequentially cutting out an area of a panel and fastening a ferrule having a plurality of fastening tines in the cut out comprising: a male die; said male die having a cutting end, an annular groove above said cutting end and a shank portion including a camming surface; an abutment; an anvil member capable of being actuated by a ram of a conventional press machine; said male die and said abutment being secured to said anvil for movement therewith; a female die housing; a female die; a spring continually biasing said female die upwardly in said housing to a normal cutting position; a latching lug on said female die; a detent carriage assembly in said housing; sparing means biasing said detent carriage assembly to a normal upward position; a detent mounted for lateral extended and retracted movement in said detent carriage assembly, said movement being normal to the spring biased upward position of said carriage assembly; spring means normally biasing said detent to an extended latching position in engagement with said latching lug on said female die; first cam means on said detent; second cam means on said female housing; and a countersink surface in said female die whereby a ferrule placed upon said male die with its tines in the die annular groove is moved toward said female die by said anvil engaging said male die with said female die cutting an area out of a panel placed therebetween; this movement also engages said abutment with said carriage assembly moving it downwardly compressing the female die biasing spring while simultaneously engaging the male die shank portion with the ferrule tines extending through said cut out area in an interference fit depressing a portion of said panel and forming a countersink therein; continued movement of said male die into said female die and depression of said carriage assembly against its upwardly biasing springs eventually unlatches said detent from said latching lug on said female die permitting the female die biasing spring to rapidly move the die upwardly such that the outwardly deflected tines of said ferrule are received in its countersink surface clenching said tines against the underneath side of said panel and securing said ferrule in said cut out.

* * * * *